US011492778B2

(12) United States Patent
Reang

(10) Patent No.: US 11,492,778 B2
(45) Date of Patent: Nov. 8, 2022

(54) CIRCLE ASSEMBLY FOR A MOTOR GRADER

(71) Applicant: Caterpillar Inc., Peoria, IL (US)

(72) Inventor: Davida Ray Reang, Chennai (IN)

(73) Assignee: Caterpillar Inc., Peoria, IL (US)

( * ) Notice: Subject to any disclaimer, the term of this patent is extended or adjusted under 35 U.S.C. 154(b) by 363 days.

(21) Appl. No.: 15/930,560

(22) Filed: May 13, 2020

(65) Prior Publication Data

US 2021/0355653 A1 Nov. 18, 2021

(51) Int. Cl.
*E02F 3/76* (2006.01)
*E02F 3/84* (2006.01)

(52) U.S. Cl.
CPC ..... *E02F 3/7627* (2013.01); *E02F 3/764* (2013.01); *E02F 3/844* (2013.01)

(58) Field of Classification Search
CPC ..... E02F 3/7627; E02F 3/764; E02F 3/844
USPC ..... 172/455
See application file for complete search history.

(56) References Cited

U.S. PATENT DOCUMENTS 5,667,020 A * 9/1997 Palmer ..... E02F 3/765 74/448
7,575,068 B2 * 8/2009 Stubben ..... E02F 3/7645 172/445.2
8,464,803 B2 * 6/2013 Greuel ..... E02F 3/765 172/795
8,869,910 B2 * 10/2014 Greuel ..... E02F 3/844 172/792
11,230,820 B2 * 1/2022 Harshman ..... E02F 3/764
2015/0019092 A1 * 1/2015 Morimoto ..... F16D 48/06 701/68
2015/0259880 A1 * 9/2015 Sharma ..... E02F 9/2025 701/43
2019/0163868 A1 * 5/2019 Gokule ..... G06F 30/15
2021/0355653 A1 * 11/2021 Reang ..... E02F 3/764

FOREIGN PATENT DOCUMENTS

IN 201621020427 A 12/2017
WO 2018160113 A1 9/2018
WO 2019207681 A1 10/2019

* cited by examiner

*Primary Examiner* — Yazan A Soofi

(57) ABSTRACT

A circle assembly for supporting implement of motor grader is provided. The circle assembly rotates relative to drawbar about rotation axis. The circle assembly includes plate and rim member coupled to plate. The plate defines front section and rear section and includes a ring gear portion defining a plurality of teeth formed integrally therein. A first skirt portion and a second skirt portion integrally and contiguously extend from ring gear portion at rear section. The first skirt portion and second skirt portion are angled relative to ring gear portion in direction of rotation axis. The rim member includes first arm member and second arm member attached to first skirt portion and second skirt portion, respectively, and a circumferential belt portion extending between the first arm member and the second arm member. The belt portion is spaced from and surrounds ring gear member at the front section of the plate.

20 Claims, 6 Drawing Sheets

CIRCLE ASSEMBLY FOR A MOTOR GRADER

TECHNICAL FIELD

The present disclosure generally relates to motor graders. More particularly, the present disclosure relates to a circle assembly of the motor graders.

BACKGROUND

Motor graders are commonly applied for various earth moving operations, such as road maintenance, surface contouring, ditch work, etc. Generally, motor graders include a main frame having a steerable front frame and a driven rear frame. The front frame supports a drawbar-circle-blade (DCB) arrangement to perform the one or more grading operations. The DCB arrangement includes a drawbar assembly, a circle assembly, and a blade assembly (e.g., a moldboard), each of which functions in concert with the other to perform the one or more grading operations. The blade assembly is tiltably mounted on to the circle assembly, which in turn is rotatably mounted to the drawbar assembly for rotating the blade assembly relative to the drawbar assembly.

Generally, the circle assembly includes a ring gear that engages with a drive gear, generally mounted on the drawbar assembly, to rotate the circle assembly, and in turn the blade assembly, relative to the drawbar assembly. Typically, the ring gear is coupled to (e.g., by welding) to a diaper plate, which in turn is further attached to a pair of implement supporting arms that support the implement. The ring gear is typically formed by processes, including forging, which are expensive. Further, assembling the entire circle assembly involves complex welding joints, such as the one generally found between the ring gear and the diaper plate. Moreover, since the circle assembly is exposed to heavy stresses during the various grading operations, even for a small damage or issue, it may be required to change the entire assembly, which may be expensive, and hence not desirable.

PCT Publication No. WO 2019/207681 (hereinafter referred to as the '681 publication) provides a motor grader including a draw bar having a draw bar plate, a bearing having an outer ring affixed to the lower surface of the draw bar plate, and having an inner ring disposed inside the outer ring and connected to the outer ring so as to be rotatable in a circumferential direction. The motor grader further includes a circle having a circle plate affixed along the circumference thereof to the lower end of the inner ring. The circle includes an outer peripheral side wall which is connected to the outer peripheral side of the circle plate, has a circular cylindrical shape surrounding the bearing from the outer peripheral side, and forms a clearance between the outer peripheral side wall and the lower surface of the draw bar plate. The circle further includes an inner peripheral side wall which protrudes between the bearing and the outer peripheral side wall from the upper surface of the circle plate, extends in the circumferential direction, and faces the outer ring from the outside in a radial direction.

SUMMARY OF THE INVENTION

In one aspect, a circle assembly for supporting implement of motor grader is provided. The circle assembly rotates relative to drawbar about rotation axis. The circle assembly includes a plate and a rim member coupled to the plate. The plate defines a front section and a rear section and includes a ring gear portion defining a plurality of teeth formed integrally therein. A first skirt portion and a second skirt portion extend integrally and contiguously from the ring gear portion at the rear section of the plate. The first skirt portion and the second skirt portion are angled relative to the ring gear portion in a direction of the rotation axis. Further, the rim member includes a first arm member and a second arm member attached to the first skirt portion and the second skirt portion, respectively. The rim member also includes a circumferential belt portion extending between the first arm member and the second arm member. The circumferential belt portion is spaced from and surrounds ring gear member at the front section of the plate.

In another aspect, a method of manufacturing a circle assembly for a motor grader, is provided. The circle assembly is adapted to support an implement thereto and rotate relative to a drawbar assembly about a rotation axis. The method includes providing a plate defining a front section and a rear section. A plurality of teeth is formed integrally to the plate to define a ring gear portion of the plate. A first section and a second section are fabricated at the front section of the plate. Further, each of the first section and the second section bent to be angled relative to the ring gear portion in a direction of the rotation axis to form a first skirt portion and a second skirt portion, respectively, of the plate. The method further includes attaching a rim member to the plate. The rim member includes a first arm member, a second arm member and a circumferential belt portion extending between the first arm member and the second arm member. The method further includes attaching the first skirt portion and the second skirt portion to the first arm member and the second arm member, respectively. Furthermore, the circumferential belt portion is attached to the ring gear portion such that the circumferential belt portion is spaced from and surrounds the ring gear portion at the rear section.

In yet another aspect, a motor grader is provided. The motor grader includes a main frame, a circle assembly and a drawbar assembly. The drawbar assembly includes a first end and a second end, the first end being attached to the main frame. The circle assembly supports an implement of the motor grader and is rotatably attached to the second end of the drawbar assembly. The circle assembly is configured to rotate relative to the drawbar assembly about a rotation axis. The circle assembly includes a plate, a rim member coupled to the plate and a C-shaped support plate attached to a bottom surface of the plate and the rim member. The plate defines a front section and a rear section and includes a ring gear portion defining a plurality of teeth formed integrally therein. A first skirt portion and a second skirt portion extend integrally and contiguously from the ring gear portion at the rear section of the plate. The first skirt portion and the second skirt portion are angled relative to the ring gear portion in a direction of the rotation axis. Further, the rim member includes a first arm member and a second arm member attached to the first skirt portion and the second skirt portion, respectively. The rim member also includes a circumferential belt portion extending between the first arm member and the second arm member. The circumferential belt portion is spaced from and surrounds ring gear member at the front section of the plate. Furthermore, the C-shaped support plate includes a first curvature end and a second curvature end attached to the rim member.

DETAILED DESCRIPTION

Figure 1:
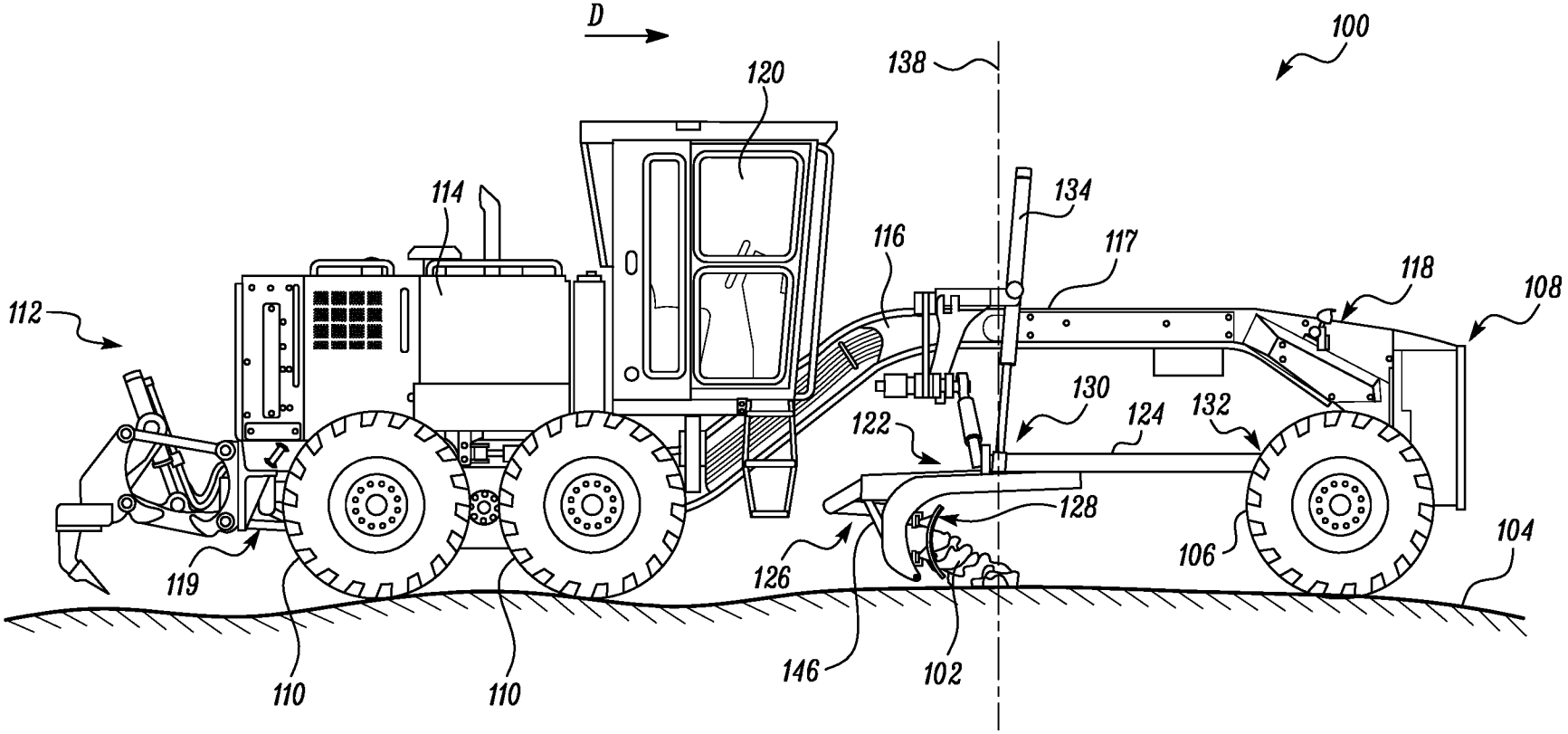
FIG. 1 illustrates an exemplary grader machine, according to the embodiments of the present disclosure.

The present disclosure relates to a circle assembly for a grader machine. FIG. 1 illustrates an exemplary grader machine 100 in accordance with the various embodiments of the present disclosure. In an embodiment of the present disclosure, the grader machine 100, hereinafter referred to as the machine 100, is embodied as a motor grader. The machine 100 may be used to displace, spread, distribute, level, and grade materials 102, such as soil, over a work surface 104. Generally, a grading operation is performed during machine movement, and for this purpose, the machine 100 may include traction devices that facilitate movement over the work surface 104. For example, traction devices include a set of front wheels 106 (only one side shown) disposed towards a front end 108 of the machine 100 and a set of rear wheels 110 disposed towards a rear end 112 of the machine 100. The terms 'front' and 'rear', as used herein, are in relation to a direction of travel of the machine 100, as represented by arrow, D, in FIG. 1, with said direction of travel being exemplarily defined from the rear end 112 towards the front end 108. The movement of the traction devices (i.e. rotation of the set of front wheels 106 and set of rear wheels 110) may be powered by a power source, such as an engine (not shown), housed within a power compartment 114 of the machine 100.

Further, the machine 100 includes a main frame 116 including a steerable front section 118 at the front end 108 and a driven rear section 119 at the rear end 112 of the machine 100. An operator cab 120 is supported on the main frame 116 and houses controls of the power source and various implements of the machine 100.

Figure 2:
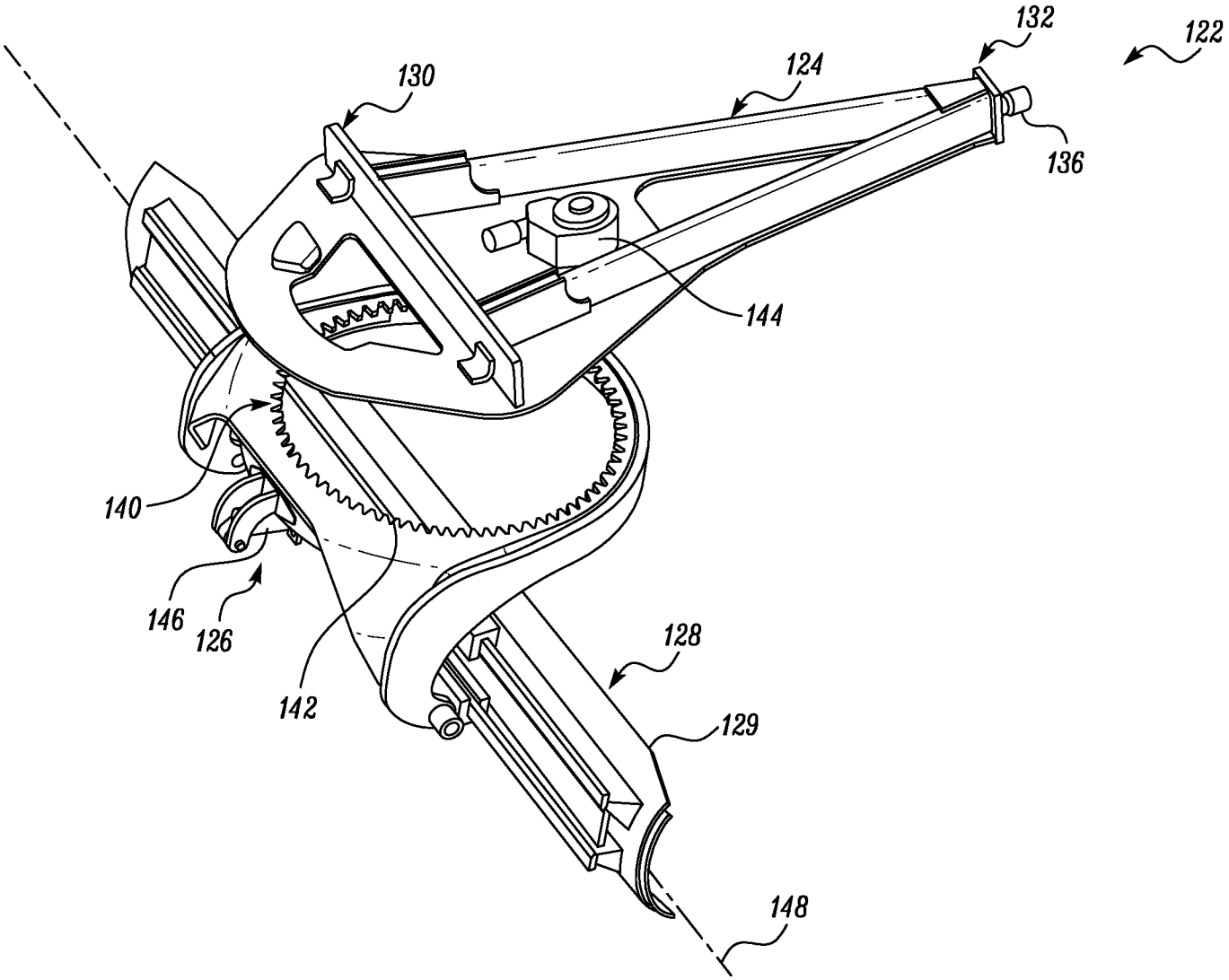
FIG. 2 illustrates an exemplary drawbar-circle-blade (DCB) assembly of the grader machine, according to the embodiments of the present disclosure.

Referring to FIGS. 1 and 2, the machine 100 includes a drawbar-circle-blade (DCB) arrangement 122—also referred to as a grader group 122 for grading and levelling the material 102. As illustrated, the grader group 122 is supported by and underneath the main frame 116 and is connected to the front section 118 of the main frame 116. In some alternative embodiments, that the grader group 122 may be supported by another portion of the machine 100, such as by the rear section 119 or by another portion of the front section 118 of the main frame 116. The grader group 122 may include a drawbar assembly 124, a circle assembly 126, and an implement assembly, such as a blade assembly 128, each of which may function in concert to perform a grading operation on the work surface 104.

The drawbar assembly 124 includes a first end 130 and a second end 132, where the first end 130 of the drawbar assembly 124 rotatably supports the circle assembly 126 and the blade assembly 128 thereto. Further, the first end 130 of the drawbar assembly 124 is movably supported by a mid-section 117 of the main frame 116, for example, via one or more lifting mechanisms, such as hydraulic actuators 134 (only one shown). The hydraulic actuators 134 may be actuated to raise or lower the first end 130 of the drawbar assembly 124 with respect to the main frame 116, in turn allowing the grader group 122 to be raised or lowered relative to the work surface 104.

Further, the drawbar assembly 124 is supported beneath the main frame 116, such that the second end 132 of the drawbar assembly 124 is pivotally connected to the front section 118 of the main frame 116. For example, the second end 132 of the drawbar assembly 124 is connected to the main frame 116 via an articulation ball joint 136 (shown in FIG. 2). The articulation ball joint 136 may be configured to facilitate side-to-side swinging of the grader group 122 about a swing axis (not shown) of the articulation ball joint 136.

The circle assembly 126 is configured to be attached underneath the drawbar assembly 124 and rotate relative to the drawbar assembly 124 about a rotation axis 138 that passes through a center of the circle assembly 126. In an exemplary embodiment, the circle assembly 126 includes a ring gear portion 140 having a plurality of teeth 142 (shown in FIG. 2) configured to engage with a drive gear 144 on the drawbar assembly 124 to facilitate the rotation of the circle assembly 126 about the rotation axis 138. In some examples, the drawbar assembly 124 may include mounting rails (not shown) arranged in circular array to engage with corresponding circle shoe assemblies (not shown) disposed on the circle assembly 126 to couple the circle assembly 126 to the drawbar assembly 124. The attachment of the circle assembly 126 to the drawbar assembly 124 is well known in art and therefore not included in the description for the sake of brevity.

The blade assembly 128 includes a moldboard 129 mounted to the circle assembly 126 for rotation about the rotation axis 138. Further, the circle assembly 126 may include one or more tilt actuators 146 coupled to the moldboard 129 to facilitate tilting of the blade assembly 128 about a horizontal axis 148 that is generally orthogonal to the direction of travel D of the machine 100.

Figure 3:
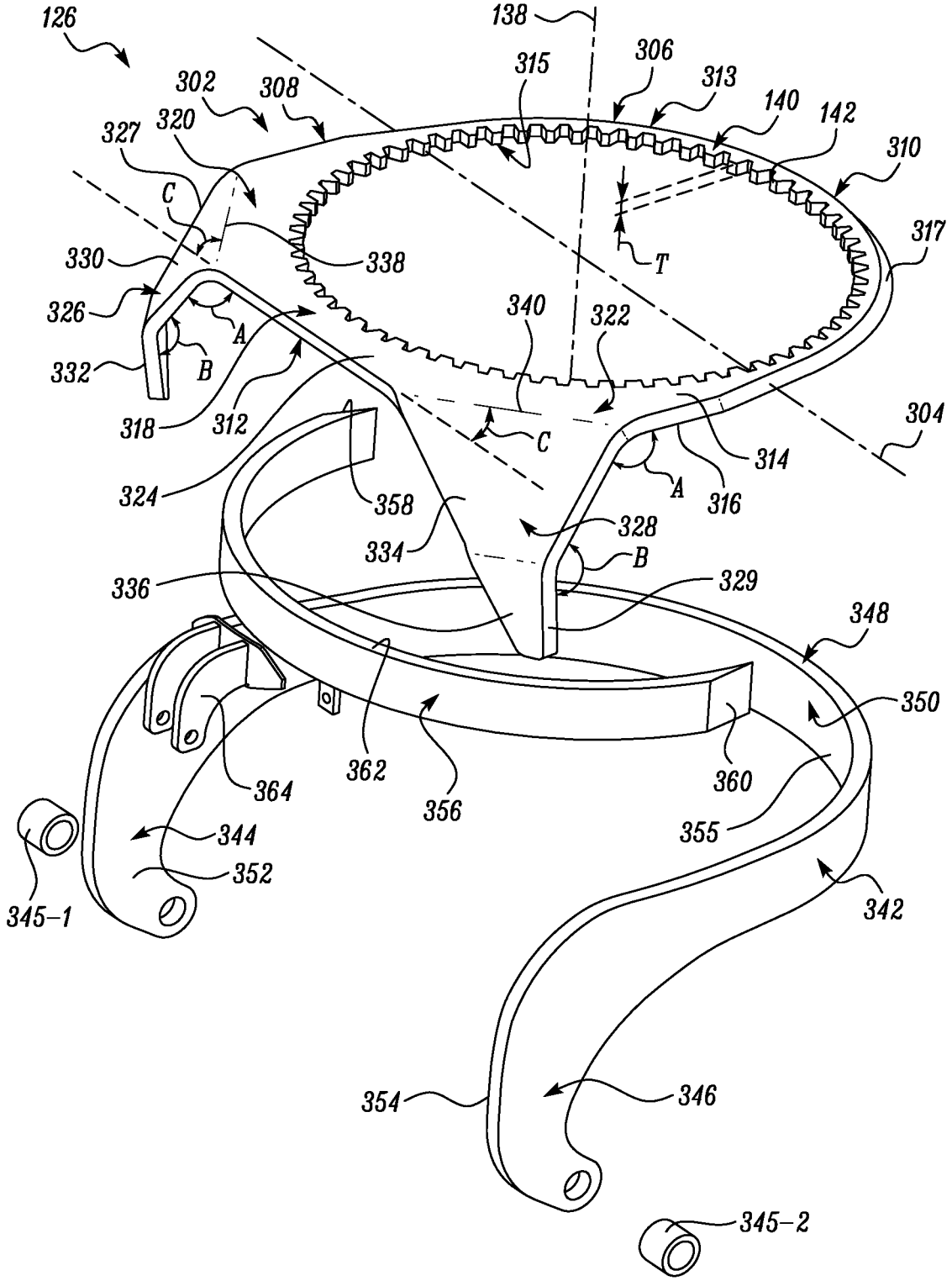
FIG. 3 illustrates an exploded view of an exemplary circle assembly, according to the embodiments of the present disclosure.
Figure 4:
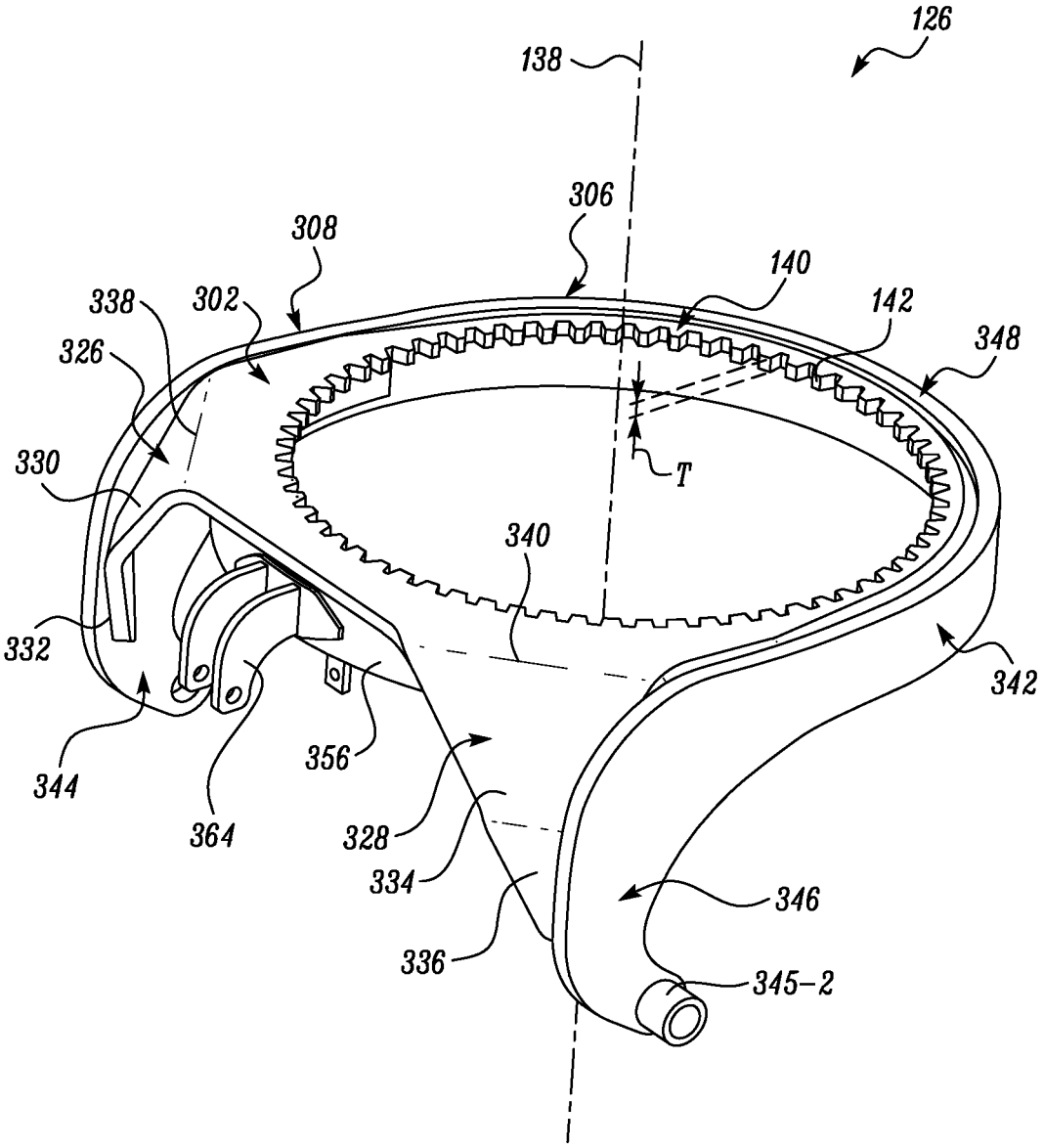
FIG. 4 illustrates the exemplary circle assembly, according to the embodiments of the present disclosure.

FIGS. 3 and 4 illustrate the exemplary circle assembly 126, according to the embodiments of the present disclosure. As illustrated, the circle assembly 126 includes a plate 302 defining a central horizontal axis 304 that divides the plate 302 into two sections, such as a front section 306 and a rear section 308. The front section 306 defines a curved front end 310 while the rear section 308 defines a rear end 312 of the plate 302. The plate 302 also defines an outer surface 313, a top surface 314 and a bottom surface 316, such that the top surface 314 is configured to interface with the drawbar assembly 124 whereas the bottom surface 316 is configured to face the blade assembly 128. The top surface 314 and the bottom surface 316 define a thickness T of the plate 302.

In an exemplary embodiment of the present disclosure, the plate 302 includes the ring gear portion 140 formed integrally therein. For example, the ring gear portion 140 is formed integrally within the plate 302 so as to extend partially in both the front section 306 and the rear section 308. The ring gear portion 140 defines an inner circumferential surface 315 and includes the plurality of teeth 142 formed continuously and integrally through the thickness T of the plate 302 on the inner circumferential surface 315 of the ring gear portion 140. The ring gear portion 140 further defines an outer arcuate surface 317 lying within the front section 306 of the plate 302. In an exemplary implementation, the ring gear portion 140 and the teeth 142 are formed by the process of flame cutting. However, other methods of forming the ring gear portion 140 and teeth 142 may also be embodied without deviating from the scope of the claimed subject matter.

The plate 302 includes a base portion 318 extending between the ring gear portion 140 and the rear end 312 of the plate 302. The base portion 318 includes a first section 320, a second section 322 laterally spaced from the first section 320, and an intermediate section 324 extending between and connecting the first section 320 and the second section 322.

In an embodiment of the present disclosure, the plate 302 includes a first skirt portion 326 and a second skirt portion 328 extending integrally and contiguously from the ring gear portion 140 at the rear section 308 of the plate 302. For example, the first skirt portion 326 is bent from the first section 320 to be angled relative to the base portion 318 and the ring gear portion 140 in a direction of the rotation axis 138. Similarly, the second skirt portion 328 is bent from the second section 322 to be angled relative to the base portion 318 and the ring gear portion 140 in the direction of the rotation axis 138. As illustrated, each of the first skirt portion 326 and the second skirt portion 328 is bent downward to protrude from the bottom surface 316 of the plate 302 in the direction of the rotation axis 138. Furthermore, the first skirt portion 326 defines a first outer surface 327 and the second skirt portion 328 defines a second outer surface 329 such that the first outer surface 327 and the second outer surface 329 together with the outer arcuate surface 317 of the ring gear portion 140 form the outer surface 313 of the plate 302.

In an exemplary embodiment of the present disclosure, each of the first skirt portion 326 and the second skirt portion 328 includes a respective first bent portion extending from and angled relative to the base portion 318 and a second bent portion extending from and angled relative to the first bent portion. For example, the first skirt portion 326 is bent from the first section 320 of the base portion 318 to define a first bent portion 330 forming a first transition edge 338 with the first section 320. Further, the first skirt portion 326 includes a second bent portion 332 bent from and angled relative to the first bent portion 330. Similarly, the second skirt portion 328 is bent from the second section 322 of the base portion 318 to define its first bent portion 334 forming a second transition edge 340 with the second section 322. Furthermore, the second skirt portion 328 includes a second bent portion 336 bent from and angled relative to the first bent portion 334. Each of the second bent portions 332 and 336 are bent inwards towards the rotation axis 138 of the circle assembly 126.

As illustrated, each of the first bent portions 330 and 334 are bent downward at a first angle A relative to the base portion 318 in the direction of the rotation axis 138, whereas each of the second bent portions 332 and 336 are bent at a second angle B relative to the respective first bent portions 330 and 334. In an exemplary implementation, the value of the first angle A lies within a range of 63 degrees to 67 degrees and the value of the second angle B lies within a range of 25 degrees to 35 degrees. In the illustrated example, the value of the first angle A is 65 degrees whereas the value of second angle B is 30 degrees. Furthermore, each of the first transition edge 338 and the second transition edge 340 is configured to form a third angle C relative to the intermediate section 324 of the base portion 318. In an exemplary implementation, the third angle C lies within a range of 42 degrees to 46 degrees. In the illustrated embodiment, the value of the third angle C is 44 degrees.

The circle assembly 126 further includes a rim member 342 coupled underneath the plate 302. For example, the rim member 342 includes a first arm member 344, a second arm member 346 and a circumferential belt portion 348 extending between and connecting the first arm member 344 and the second arm member 346, thereby forming a U-shape of the rim member 342. The rim member 342 defines an inner surface 350 comprising of a combination of an inner surface 352 of the first arm member 344, an inner surface 354 of the second arm member 346 and an inner surface 355 of the circumferential belt portion 348. Each of the first arm member 344 and the second arm member 346 are configured to tiltably mount the implement, such as the moldboard 129 of the blade assembly 128, via one or more fasteners 345-1 and 345-2.

In an embodiment of the present disclosure, the first arm member 344 is configured to be attached to the first skirt portion 326 while the second arm member 346 is configured to be attached to the second skirt portion 328 of the plate 302. The circumferential belt portion 348 is configured to be spaced from and surround the ring gear portion 140 at the front section 306 of the plate 302. In an exemplary implementation, the inner surface 350 of the rim member 342 is configured to be attached to the outer surface 313 of the plate 302. For example, as shown in FIG. 4, the outer surface 327 of the first skirt portion 326 is configured to be attached to the inner surface 352 of the first arm member 344. Similarly, the outer surface 329 of the second skirt portion 328 is configured to be attached to the inner surface 354 of the second arm member 346. Furthermore, the inner surface 355 of the circumferential belt portion 348 is configured to be attached to the outer arcuate surface 317 of the ring gear portion 140 in the front section 306 of the plate 302. In one example, the rim member 342 is attached to the plate 302 by welding. However, other coupling mechanisms for attaching the rim member 342 to the plate 302 may be also be contemplated without deviating from the scope of the claimed subject matter.

The circle assembly 126 further includes a support plate 356 having a C-shaped structure and defining a first curvature end 358, a second curvature end 360 and a top face 362. In an embodiment, the support plate 356 is configured to be attached to the bottom surface 316 at the rear section 308 of the plate 302. For example, the top face 362 of the support plate 356 is attached to the bottom surface 316 of the plate 302 at the base portion 318 and is configured to be positioned adjacent to the ring gear portion 140 in the rear section 308 of the plate 302. Further, the first curvature end 358 and the second curvature end 360 of the support plate 356 are configured to be attached at respective portions, such as to the inner surface 355 of the circumferential belt portion 348 of the rim member 342. It may be contemplated that the shape of the support plate 356 is merely exemplary and may be varied to achieve similar results without deviating from the scope of the claimed subject matter.

The circle assembly 126 further includes a mounting structure 364 coupled to the support plate 356. The mounting structure 364 is configured to support the one or more tilting actuators (such as the tilt actuator 146 shown in FIGS. 1 and 2) to facilitate tilting of the blade assembly 128 relative to the circle assembly 126 and about the horizontal axis 148. As illustrated, the mounting structure 364 is attached to the support plate 356 such that the mounting structure 364 is positioned underneath the rear end 312 of the plate 302. The tilting actuator 146 may be a hydraulic actuator having one end coupled to the mounting structure 364 and the other end coupled to the moldboard 129. The tilting actuator 146 may be coupled to the mounting structure 364 via a pin fastener or any other fastening mechanism known in the art.

INDUSTRIAL APPLICABILITY

Figure 5A:
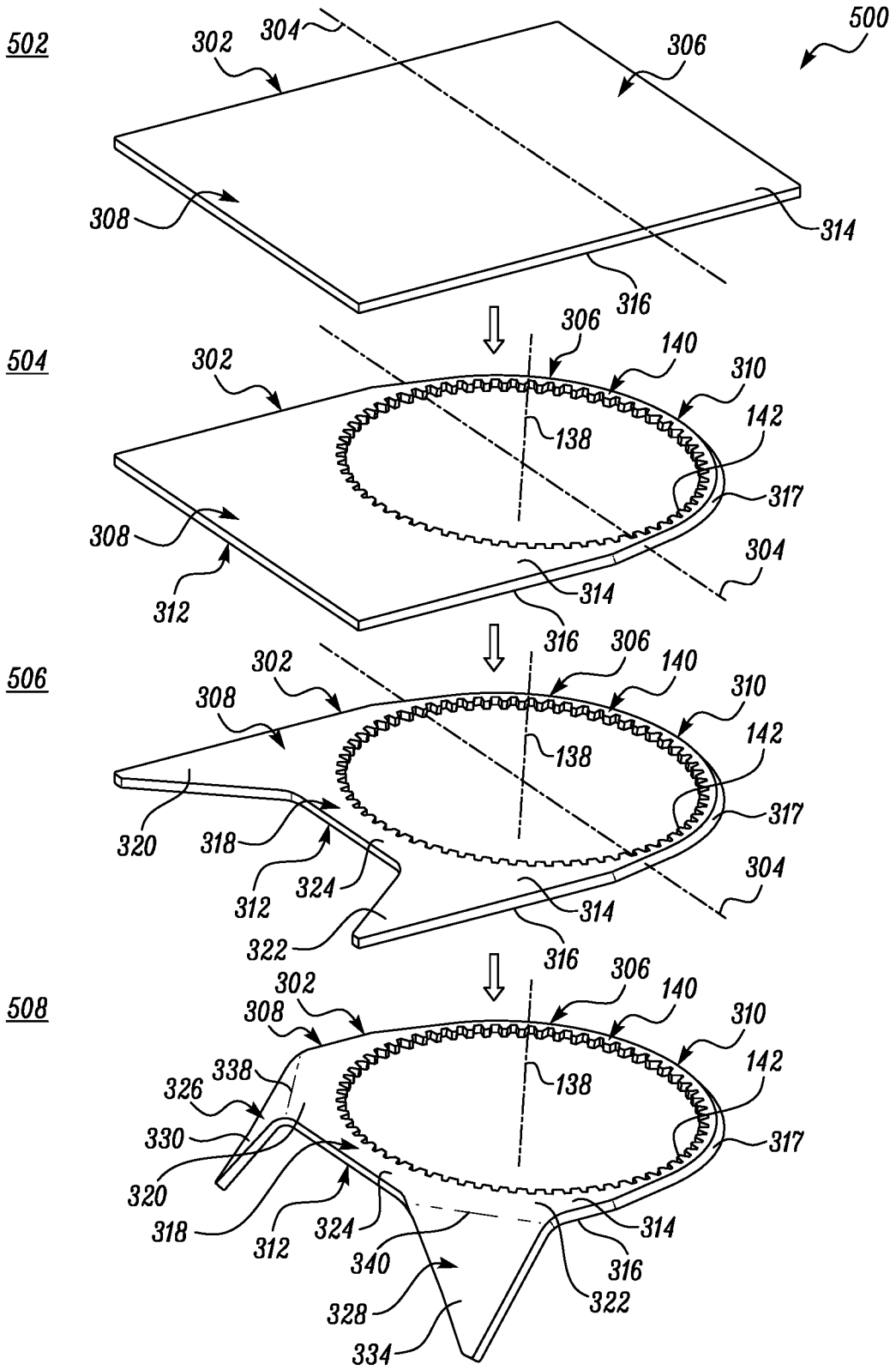
FIGS. 5A and 5B illustrates an exemplary method of manufacturing the circle assembly, according to the embodiments of the present disclosure.
Figure 5B:
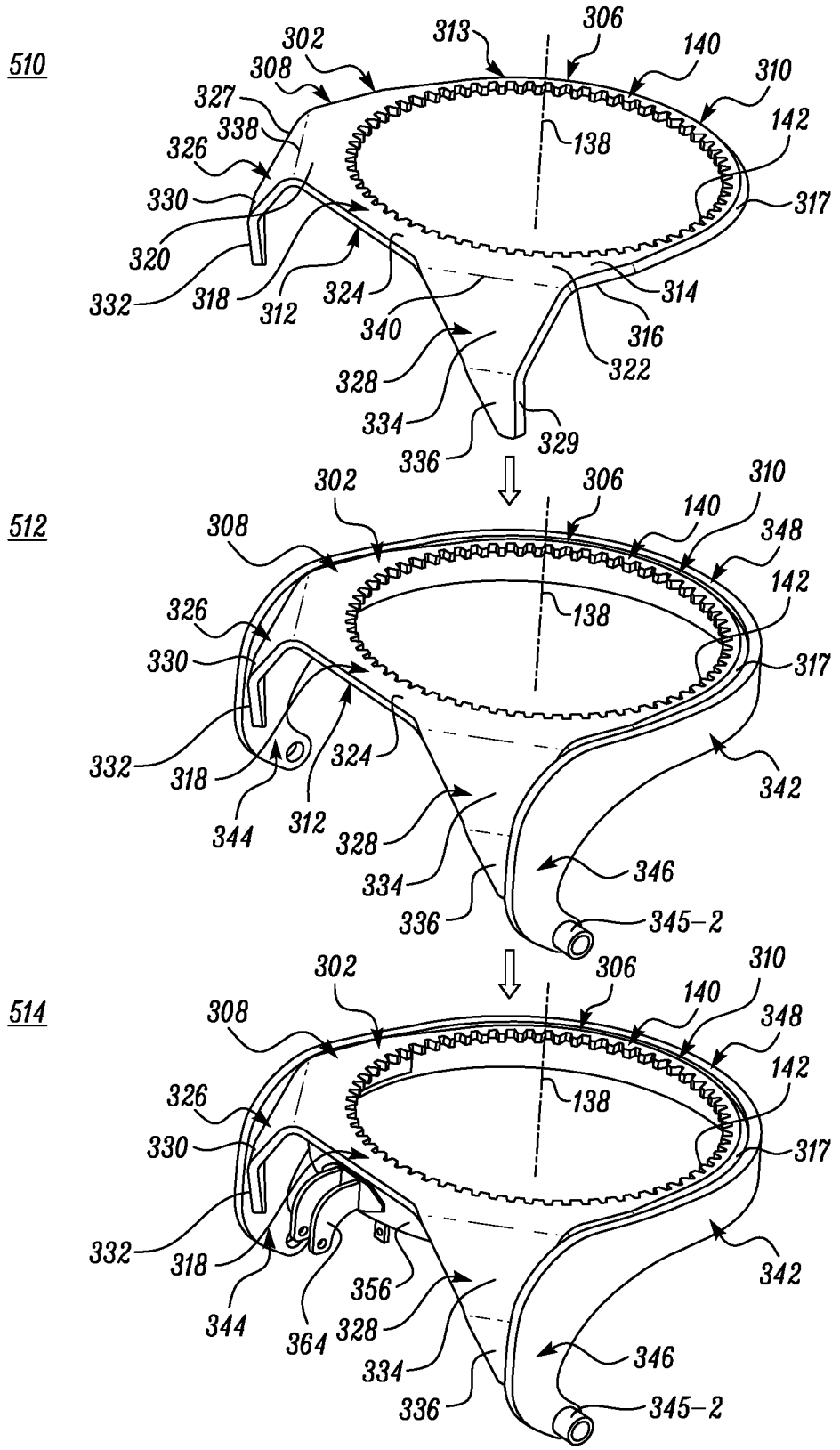

Referring to FIGS. 5A and 5B, an exemplary method 500 of manufacturing the circle assembly 126, according to the embodiments of the present disclosure, is described. The method 500 begins with providing the plate 302, wherein the plate 302 defines a central horizontal axis 304 which further defines a front section 306 and a rear section 308 of the plate 302. The plate 302 also includes a top surface 314 and a bottom surface 316, such that the top surface 314 and the bottom surface 316 define the thickness T of the plate 302. It is to be understood that the plate 302 acts as a base plate on which the ring gear portion 140, the teeth 142 and the first and the second skirt portions 326, 328 are eventually formed according to the following steps of the method 500 described in the following description.

The method proceeds to step 504 where a plurality of teeth 142 are formed integrally within the plate 302 to define the ring gear portion 140, such that the ring gear portion 140 lies partially within the front section 306 and partially within the rear section 308 of the plate 302. In an embodiment of the present disclosure, the plurality of teeth 142 are formed integrally to extend across the thickness T of the plate 302. A central axis of the ring gear portion 140 defines the rotation axis 138 of the resultant circle assembly 126, about which the circle assembly 126 rotates relative to the drawbar assembly 124 (as shown in FIG. 1). In one example, the plurality of teeth 142 and the ring gear portion 140 are formed by flame cutting process. However, it is to be understood that the scope of the disclosure is not limited to forming the ring gear portion 140 by flame cutting process, as any other similar and/or suitable techniques may be used to form the ring gear portion 140. As such, the formation of the ring gear portion 140 results in formation of the curved front end 310 of the plate 302 that defines the outer arcuate surface 317 of the ring gear portion 140. For example, after forming the ring gear portion 140 and the teeth 142, the resultant surfaces are machined to obtain the smoothed surfaces of the teeth 142 as well as the outer arcuate surface 317 of the ring gear portion 140 and consequently the curved front end 310 of the plate 302.

A portion of the plate 302 extending between the ring gear portion 140 and the rear end 312 of the plate 302 forms the base portion 318 disposed in the rear section 308 of the plate 302. At step 506, the base portion 318 is cut and machined to form a first section 320, a second section 322 laterally spaced apart from the first section 320 and an intermediate section 324 connecting and extending between the first section 320 and the second section 322. As shown, the first section 320 and the second section 322 are triangular sections protruding from lateral ends of the intermediate section 324.

Further, at step 508, each of the first section 320 and the second section 322 are bent relative to the ring gear portion 140 to form the first skirt portion 326 and the second skirt portion 328, respectively. As illustrated, the first skirt portion 326 and the second skirt portion 328 are bent downward from the first section 320 and the second section 322, respectively, in the direction of the rotation axis 138 to extend from the bottom surface 316 of the plate 302. In an embodiment of the present disclosure, the first skirt portion 326 is bent from the first section 320 of the base portion 318 to define a first bent portion 330 forming a first transition edge 338 with the first section 320. Similarly, the second skirt portion 328 is bent from the second section 322 of the base portion 318 to define its first bent portion 334 forming a second transition edge 340 with the second section 322. Each of the first bent portions 330 and 334 are bent downward at an angle A relative to the base portion 318 in the direction of the rotation axis 138, whereas each of the first transition edge 338 and the second transition edge 340 forms an angle C relative to the intermediate section 324 of the base portion 318 (as shown in FIG. 3).

At step 510, a second bent portion, such as the second bent portion 332 of the first skirt portion 326 and the second bent portion 336 of the second bent portion 328 is formed. A second portion of first section 320 and the second section 322 is turned at an angle B with respect to the respective first bent portions 330, 334 to form the second bent portions 334 and 336, respectively.

At the end of step 510, the resultant plate 302 includes the ring gear portion 140, the first skirt portion 326 and the second skirt portion 328, each having the first bent portion 330, 334 and the second bent portion 332, 336, which is to be attached to other components to finally form the circle assembly 126 in the subsequent steps. As shown, the resultant plate 302 defines the outer surface 313 including the arcuate outer surface 317 at the front end 310 and the outer surfaces 327 and 329 at the first skirt portion 326 and the second skirt portion 328, respectively.

At step 512, the rim member 342 is coupled to the plate 302 formed at the end of step 510. The rim member 342 includes the first arm member 344, the second arm member 346 and the circumferential belt portion 348 extending between the first arm member 344 and the second arm member 346. The rim member 342 defines its inner surface 350, which is a combination of the inner surface 352 at the first arm member 344, the inner surface 354 at the second arm member 346 and the inner surface 355 at the circumferential belt portion 348. In an embodiment of the present disclosure, the outer surface 313 of the plate 302 is attached to the inner surface 350 of the rim member 342. For example, the inner surface 352 of the first arm member 344 is attached to the outer surface 327 of the first skirt portion 326 while the inner surface 354 of the second arm member 346 is attached to the outer surface 329 of the second skirt portion 328 of the plate 302. Further, the circumferential belt portion 348 is spaced from and surrounds the ring gear portion 140 at the front section 306 of the plate 302, such that the inner surface 355 of the circumferential belt portion 348 is attached to the outer arcuate surface 317 at the front end 310 of the plate 302. In some implementations, the inner surface 350 of the rim member 342 is attached to the outer surface 313 of the plate 302 by welding. However, other fastening mechanisms may also be embodied without deviating from the scope of the claimed subject matter.

Once the rim member 342 is attached to the plate 302, the support plate 356 is attached to the bottom surface 316 of the plate 302 and the mounting structure 364 is coupled to the support plate 356, at step 514. As explained previously, the support plate 356 is a C-shaped plate having the first curvature end 358, the second curvature end 360 and the top surface 362. At step 514, the top surface 362 of the support plate 356 is attached to the bottom surface 316 of the plate 302, while the first and the second curvature end 358, 360 are attached to the inner surface 355 of the circumferential belt portion 348 of the rim member 342. Furthermore, the mounting structure 364 is attached to the support plate 356 such that the mounting structure 364 is positioned underneath the rear end 312 of the plate 302. The mounting structure 364 is configured to support the tilt actuator 146 (shown in FIGS. 1 and 2) to facilitate tilting of the blade assembly 128 relative to the circle assembly 126.

The circle assembly 126 of the present disclosure includes a single plate, i.e., the plate 302 including the ring gear portion 140 as well as the first skirt portion 326 and the second skirt portion 328, which together serve the purpose of the conventional circle member and the diaper plates. The circle assembly 126, as disclosed in the various embodiments of the present disclosure, eliminates the conventional complex welding joints between a circle member and the diaper plate. Therefore, the plate 302 provides a strong stress protection against heavy stresses to which the circle assembly 126 is subjected to during the grading operations of the machine 100. Further, the ring gear portion 140 of the present disclosure, is formed by flame cutting process, which significantly reduces the cost of manufacturing the circle assembly 126 of the present disclosure. The circle assembly 126, is therefore more cost effective and stronger as compared to a conventional circle assembly with a circle member, having a forged ring gear portion, and diaper plates that attach the circle member to the implement supporting arms.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A circle assembly for supporting an implement of a motor grader thereto and configured to rotate relative to a drawbar assembly about a rotation axis, the circle assembly comprising:

a plate defining a front section and a rear section, the plate including:

a ring gear portion defining a plurality of teeth formed integrally therein;

a first skirt portion and a second skirt portion integrally and contiguously extending from the ring gear portion at the rear section of the plate, each of the first skirt portion and the second skirt portion being angled relative to the ring gear portion in a direction of the rotation axis;

a rim member coupled to the plate, the rim member including:

a first arm member and a second arm member attached to the first skirt portion and the second skirt portion, respectively; and a circumferential belt portion extending between the first arm member and the second arm member and being spaced from and surrounding the ring gear member at the front section of the plate.

2. The circle assembly of claim 1, wherein the plate includes a top surface and a bottom surface to define a thickness of the plate, and wherein the plurality of teeth extends across the thickness of the plate.

3. The circle assembly of claim 1, wherein the plate includes a base portion extending between the ring gear portion and the first and the second skirt portion, the base portion defining a first section, a second section and an intermediate section extending between the first section and the second section, such that the first skirt portion is formed by bending the first section and the second skirt portion is formed by bending the second section.

4. The circle assembly of claim 3, wherein each of the first skirt portion and the second skirt portion includes:

a first bent portion bent at a first angle relative to the base portion in the direction of the rotation axis and defining a transition edge with the base portion; and a second bent portion bent at a second angle with respect to the first bent portion, the second bent portion being bent towards the rotation axis.

5. The circle assembly of claim 4, wherein the transition edge of each of the first skirt portion and the second skirt portion defines a third angle with respect to the intermediate section of the base portion.

6. The circle assembly of claim 1 further including a C-shaped support plate attached to a bottom surface of the plate at the rear section.

7. The circle assembly of claim 6, wherein the C-shaped support plate defines a first curvature end and a second curvature end, each of the first curvature end and the second curvature end being attached to respective portions of the rim member.

8. The circle assembly of claim 6 further comprising a mounting structure coupled to the C-shaped support plate, the mounting structure being configured to support a tilt actuator for facilitating tilting of the implement relative to the circle assembly.

9. A method of manufacturing a circle assembly of a motor grader, the circle assembly adapted to support an implement thereto and rotate relative to a drawbar assembly about a rotation axis, the method comprising:

providing a plate defining a front section and a rear section;

forming a plurality of teeth integrally to the plate to define a ring gear portion of the plate;

fabricating a first section and a second section at the rear section of the plate;

forming each of the first section and the second section being angled relative to the ring gear portion in a direction of the rotation axis to form a first skirt portion and a second skirt portion, respectively, of the plate;

providing a rim member including a first arm member, a second arm member and a circumferential belt portion extending between the first arm member and the second arm member; and coupling the plate, having the ring gear portion and the first skirt portion and the second skirt portion, to the rim member by:

attaching the first skirt portion and the second skirt portion to the first arm member and the second arm member, respectively; and attaching the circumferential belt portion to the ring gear portion such that the circumferential belt portion is spaced from and surrounds the ring gear portion at the front section.

10. The method of claim 9, wherein the plate includes a top surface and a bottom surface to define a thickness of the plate, and wherein the plurality of teeth of the ring gear portion is formed by a flame cutting process to extend across the thickness of the plate.

11. The method of claim 9, wherein the plate includes a base portion extending between the ring gear portion and the first skirt portion and the second skirt portion, the base portion defining the first section, the second section and an intermediate section extending between the first section and the second section, and wherein bending each of the first section and the second section to form the first skirt portion and the second skirt portion includes:

turning a first portion of each of the first section and the second section at a first angle relative to the base portion in the direction of the rotation axis to define respective first bent portions of the first skirt portion and the second skirt portion; and turning a second portion of each of the first section and the second section at a second angle with respect to the respective first bent portions to define respective second bent portions of the first skirt portion and the second skirt portion, wherein each of the second bent portions are bent towards the rotation axis.

12. The method of claim 11, wherein the respective first portions of the first section and the second section define respective transition edges with the base portion, each transition edge defining a third angle with respect to the intermediate section of the base portion.

13. The method of claim 9 further comprising attaching a C-shaped support plate to a bottom surface of the plate at the rear section.

14. The method of claim 13, wherein the C-shaped support plate includes a first curvature end and a second curvature end, and wherein the method further comprises attaching each of the first curvature end and the second curvature end to respective portions of the rim member.

15. The method of claim 13 further comprising coupling a mounting structure to the C-shaped support plate for supporting a tilt cylinder thereto, the tilt cylinder being configured to facilitate tilting of the implement relative to the circle assembly.

16. A motor grader comprising:

a main frame;

a drawbar assembly having a first end and a second end, the first end being attached to the main frame; and a circle assembly for supporting an implement of the motor grader, the circle assembly being rotatably attached to the second end of the drawbar assembly and configured to rotate relative to the drawbar assembly about a rotation axis, the circle assembly including:

a plate defining a front section and a rear section, the plate including:

a ring gear portion defining a plurality of teeth formed integrally therein to engage with a drive gear and facilitate rotation of the circle assembly about the rotation axis;

a first skirt portion and a second skirt portion integrally and contiguously extending from the ring gear portion at the rear section of the plate, each of the first skirt portion and the second skirt portion being angled relative to the ring gear portion in a direction of the rotation axis;

a rim member coupled to the plate, the rim member including:

a first arm member and a second arm member attached to the first skirt portion and the second skirt portion, respectively, each of the first arm member and the second arm member tiltably mounting the implement thereto; and a circumferential belt portion extending between the first arm member and the second arm member and being spaced apart and surrounding the ring gear member at the front section of the plate; and a C-shaped support plate including a first curvature end and a second curvature end, wherein the C-shaped support plate is attached to a bottom surface of the plate in the rear section and to the rim member at the first curvature end and the second curvature end.

17. The motor grader of claim 16, wherein the circle assembly further includes a mounting structure coupled to the C-shaped support plate, the mounting structure supporting a tilt actuator for facilitating tilting of the implement relative to the circle assembly.

18. The motor grader of claim 16, wherein the plate includes a base portion extending between the ring gear portion and the first and the second skirt portion, the base portion defining a first section, a second section and an intermediate section extending between the first section and the second section, such that the first skirt portion is formed by bending the first section and the second skirt portion is formed by bending the second section.

19. The motor grader of claim 18, wherein each of the first skirt portion and the second skirt portion of the plate includes:

a first bent portion bent at a first angle relative to the base portion in the direction of the rotation axis and defining a transition edge with the base portion; and a second bent portion bent at a second angle with respect to the first bent portion, the second bent portion being bent towards the rotation axis.

20. The motor grader of claim 19, wherein the transition edge of each of the first skirt portion and the second skirt portion defines a third angle with respect to the intermediate section of the base portion.

* * * * *